United States Patent [19]

Sakai

[11] 4,250,239

[45] Feb. 10, 1981

[54] COLOR ELECTROSTATOGRAPHIC PROCESS AND MATERIAL

[75] Inventor: Katsuo Sakai, Tokyo, Japan

[73] Assignee: Ricoh Company, Ltd., Tokyo, Japan

[21] Appl. No.: 912,273

[22] Filed: Jun. 5, 1978

[30] Foreign Application Priority Data

| | | | |
|---|---|---|---|
| Jun. 9, 1977 | [JP] | Japan | 52/68343 |
| Jun. 29, 1977 | [JP] | Japan | 52/77658 |
| Jul. 11, 1977 | [JP] | Japan | 52/82660 |

[51] Int. Cl.[3] ..... G03G 13/01

[52] U.S. Cl. ..... 430/42; 430/55; 430/57

[58] Field of Search ..... 96/1 R, 1.2; 430/31, 430/42, 55

[56] References Cited

U.S. PATENT DOCUMENTS

| | | | |
|---|---|---|---|
| 2,962,375 | 11/1960 | Schaffert | 96/1.2 |
| 3,775,106 | 11/1973 | Tamai et al. | 96/1.2 |
| 3,795,513 | 3/1974 | Ciuffini | 96/1 R |
| 3,844,783 | 10/1974 | Matsumoto et al. | 96/1.2 |
| 3,884,686 | 5/1975 | Bean | 96/1.2 X |
| 4,039,831 | 8/1977 | Lehmann | 96/1.2 X |
| 4,078,929 | 3/1978 | Grundlach | 96/1.2 |

OTHER PUBLICATIONS

Schaffert, "Increasing the Sensitivity of Xerographic Photoconductors", IBM Tech. Discl. Bull., vol. 6, No. 10, Mar. 1964, p. 60.

*Primary Examiner*—Roland E. Martin, Jr.
*Attorney, Agent, or Firm*—Jordan and Hamburg

[57] ABSTRACT

A photoconductive drum formed with two photoconductive layers of different spectral sensitivty is charged a first time in the dark or while rendering one of the layers conductive and a second time with an opposite polarity in the dark to form a stratified electrostatic charge pattern. Exposure to a light image of an original document causes the layers to conduct according to color. Toner particles of two colors such as red and black adhere to respective areas of the resulting electrostatic image which have opposite polarities. Transfer of the resulting toner image to a copy sheet produces a finished copy in two colors.

19 Claims, 25 Drawing Figures

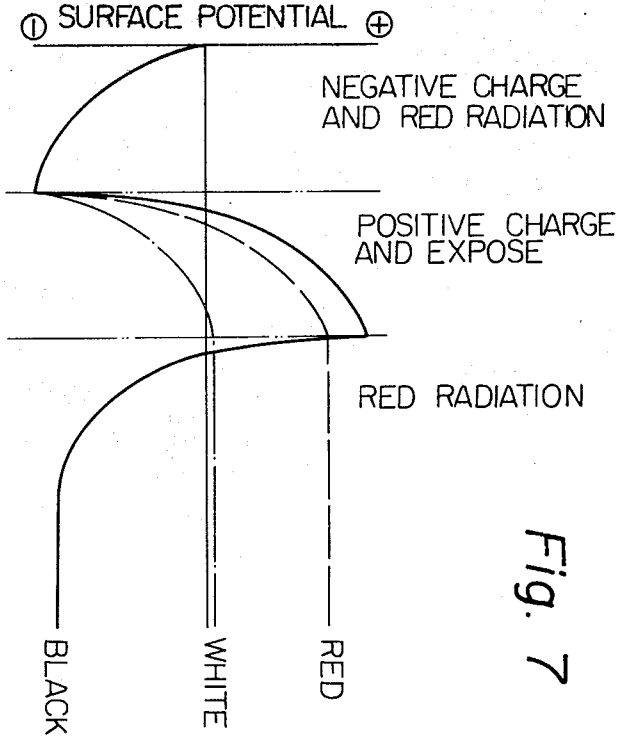
Fig. 7
Fig. 8
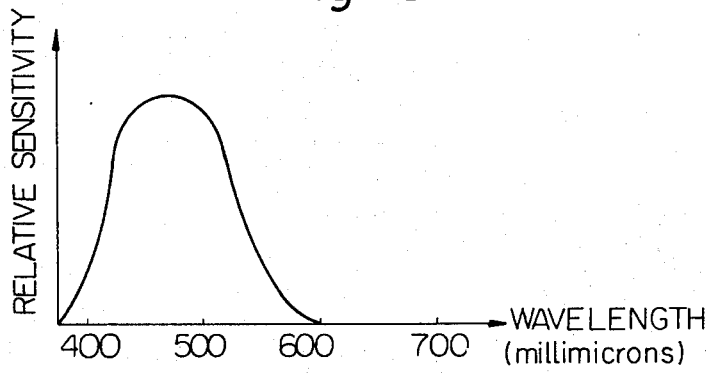

COLOR ELECTROSTATOGRAPHIC PROCESS AND MATERIAL

BACKGROUND OF THE INVENTION

The present invention relates to a two-color electrostatographic process and material.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copy machine it is essential that the toner images be transferred to the copy sheet in perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink, many offices have purchased or leased full color copying machines for copying such records. The full color copying capability is wasted since it is only necessary to distinguish red from black on the copies.

SUMMARY OF THE INVENTION

The present invention overcomes the drawbacks of the prior art by providing a simple and low cost copying machine which can produce copies in two colors, such as red and black, using only one imaging operation and comprising only one photoconductive drum or belt. In accordance with the present invention, a photoconductive material comprises a conductive substrate, an inner photoconductive layer formed on the substrate and being sensitive to visible light and an outer photoconductive layer formed on the inner layer which is insensitive to red light. The outer layer is transparent. An electrostatic charge is applied to the outer layer while radiating the material with light to make only one of the layers conduct. Then, an electrostatic charge of the opposite polarity is applied to the outer layer in the dark. A light image of an original document is radiated onto the outer layer, white areas of the image causing photoconduction of both layers and red areas thereof causing photoconduction of only the inner layer. As a result, white areas of the material have zero surface potential while red and black areas have non-zero surface potentials of opposite respective polarities. Red and black toner particles of opposite electrostatic charge are applied to the material and adhere to the respective charged areas to form a red and black toner image which is transferred to a copy sheet.

It is an object of the present invention to provide an electrostatographic process which produces copies in two colors with only one imaging operation using a single photoconductive member.

It is another object of the present invention to provide a novel and unique photoconductive material for practicing the process.

It is another object of the present invention to provide an electrostatographic process which may be performed using a simple and inexpensive apparatus.

It is another object of the present invention to provide an electrostatographic process which may be performed at high speed compared to the prior art.

It is another object of the present invention to provide an electrostatographic process which produces two color copies at greatly reduced cost compared to the prior art.

It is another object of the present invention to provide a generally improved electrostatographic process and material for practicing the same.

Other objects, together with the foregoing, are attained in the embodiments described in the following description and illustrated in the accompanying drawing.

BRIEF DESCRIPTION OF THE DRAWING

FIG. 7 is similar to FIG. 2 but illustrates the second version of the process;

FIG. 8 is a graph illustrating the spectral sensitivity of a photoconductive layer of a material used in the second version of the process;

DESCRIPTION OF THE PREFERRED EMBODIMENTS

While the electrostatographic process and material of the invention is susceptible of numerous physical embodiments, depending upon the environment and requirements of use, substantial numbers of the herein shown and described embodiments have been made, tested and used, and all have performed in an eminently satisfactory manner.

Figure 1A:
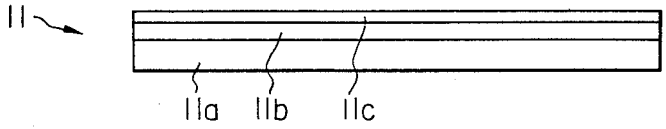
FIGS. 1*a* to 1*e* are schematic views illustrating a first version of the present electrostatographic process.

Referring now to the drawing, a photoconductive material 11 of the present invention is illustrated in FIG. 1*a*. The material 11 may be in the form of a drum, belt or sheet, although only illustrated in cross section. The material 11 comprises an electrically conductive substrate 11*a* formed of metal or the like and an inner photoconductive layer 11*b* formed on the substrate 11*a*. The layer 11*b* may be similar to that used in conventional electrostatography in that it is rendered photoconductive by visible light. The layer 11*b* may be formed with an electrically rectifying material.

Figure 4:
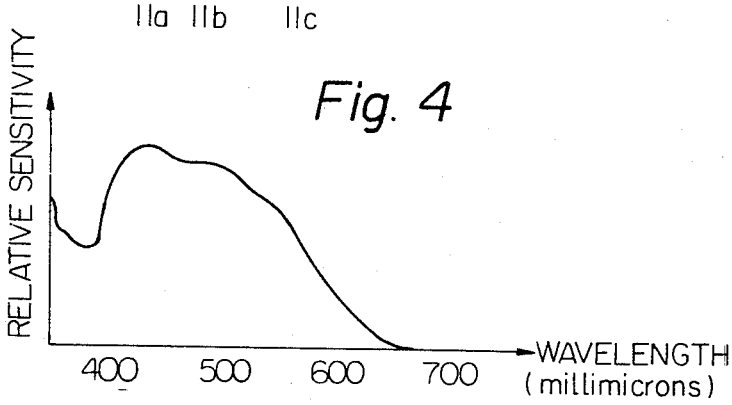
FIG. 4 is a graph illustrating the spectral sensitivity of a photoconductive layer of the present material.

In accordance with a unique feature of the present invention, an outer photoconductive layer 11*c* is formed on the inner layer 11*b*. The outer layer 11*c* is at least partially optically transparent, and is insensitive to light of a particular color. Where it is desired to make copies in black and red, the outer layer 11*c* is insensitive to red, but rendered photoconductive by light of other colors, especially cyan and white (which contains cyan). The spectral sensitivity of the outer layer 11*c* is illustrated in FIG. 4. It will be noted that the layer 11*c* is not rendered photoconductive by light having a wavelength greater than approximately 600 millimicrons. The red region begins at approximately 640 millimicrons, and therefore the outer layer 11*c* is insensitive to red light.

Figure 1B:
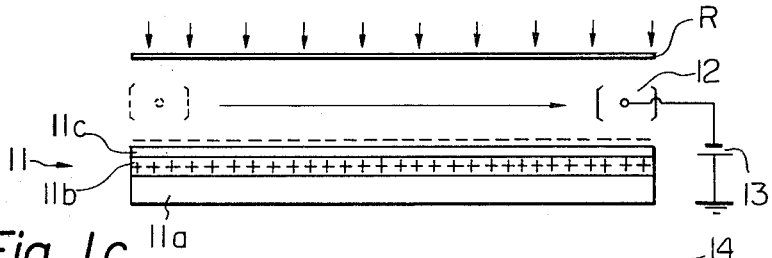

FIG. 1*b* illustrates the first steps of the process, which are performed simultaneously. A corona charging unit 12 applies a uniform negative electrostatic charge to the surface of the outer layer 11*c*, while red light is radiated thereonto. The unit 12 is powered by a negative D.C. source 13. As illustrated, white light is radiated onto the surface of the outer layer 11*c* through a red filter R. The red light causes no photoconduction in the outer layer 11*c*, but passes therethrough to the inner layer 11*b*. The red light causes the inner layer 11*b* to conduct.

The negative charge on the surface of the outer layer 11*c* induces a positive charge on the lower layer thereof. More specifically, positive charges migrate through the substrate 11*a* and lower layer 11*b* which has been rendered photoconductive by the red light upwardly to accumulate at the lower surface of the outer layer 11*c*, or at the interface of the outer layer 11*c* and inner layer 11*b*.

The same effect may be produced by charging the layer 11*c* in the dark and subsequently radiating the same with red light. In this case, during the charging the positive charges will accumulate at the lower surface of the inner layer 11*b*. When the inner layer 11*b* is rendered photoconductive by the red light, the positive charges will migrate through the inner layer 11*b* to the lower surface of the outer layer 11*c*.

In either case, when radiation of the material 11 with red light is terminated, the inner layer 11*b* is no longer rendered photoconductive and the positive charges are trapped at the interface of the layers 11*b* and 11*c*.

It is to be noted that the step mentioned above with reference to FIG. 1*b* may be performed in the dark without radiation of the red light onto the surface of the outer layer 11*c* if the inner layer 11*b* is formed with an electrically rectifying material.

Figure 1C:
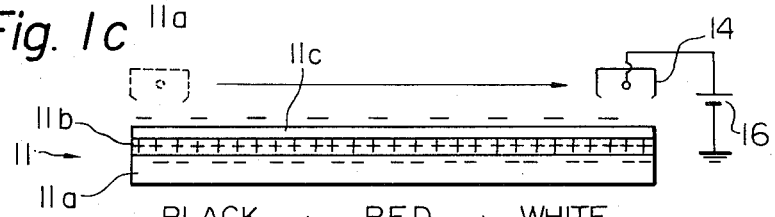

Next, as illustrated in FIG. 1*c*, a corona charging unit 14 applies a positive charge to the outer layer 11*c*. The unit 14 is powered by a positive D.C. source 16. The magnitude of the positive charge applied to the material 11 by the unit 14 is designed to the great enough to reverse the surface potential of the material 11, or charge it from negative to positive. A certain portion of the negative charge on the upper surface of the outer layer 11*c* will be neutralized by the newly applied positive charge, but a certain amount will remain due to attraction of negative charge by the trapped positive charge at the interface of the layers 11*b* and 11*c* and the repulsion thereof for the newly applied positive charge. Thus, although the charge on the upper surface of the outer layer 11*c* remains negative, the net electrostatic potential at the surface of the material 11 is positive due to the effect of the trapped positive charge at the interface of the layers 11*b* and 11*c*.

Figure 1D:
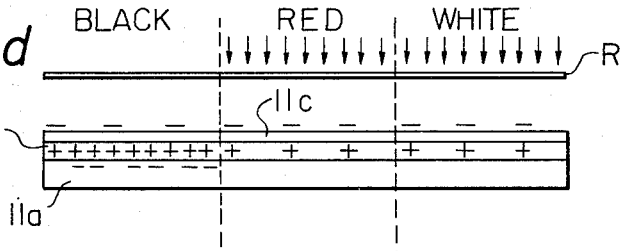

Next, a light image of an original document (not shown) is radiated onto the outer layer 11*c* through the red filter R, as shown in FIG. 1*d*. It will be assumed that the light image consists of black, red and white areas as labeled.

Since the black image area is void of visible light of any color, neither of the layers 11*b* and 11*c* is rendered photoconductive in this area. However, the inner layer 11*b* is rendered photoconductive in both the red and white image areas, since white light contains a red component. This causes a portion of the positive charge at the interface of the layers 11*b* and 11*c* to dissipate into the layer 11*b* and substrate 11*a*. Only a positive charge equal to the negative charge at the upper surface of the layer 11*c* will remain at the lower surface of the layer 11*c*. It will be noted that since the outer layer 11*c* is insensitive to red light, no photoconduction will occur in the layer 11*c* during the step of FIG. 1*d*.

Figure 1E:
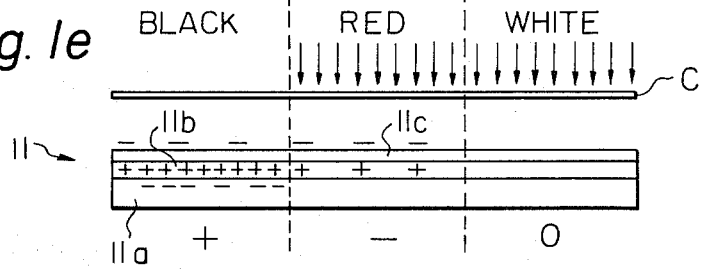

As the next step of the process, as shown in FIG. 1*e*, the light image is again radiated onto the material 11 but this time through a cyan filter C. Again, there is no change in the black area of the light image since neither of the layers 11*b* and 11*c* is rendered photoconductive. There is no substantial change in the red area of the light image since red light is absorbed by the cyan filter C. However, the cyan component of the white area of the light image renders the outer layer 11*c* photoconductive. This has the effect of dissipating the charge across the layer 11*c* and eliminating all charge in the white area of the light image.

As the result of these steps, the surface potential in the black area of the light image on the material 11 remains positive, as described above. The potential in the white image area in zero.

In the red image area, a negative charge remains on the upper surface of the upper layer 11*c*. An equal positive charge is induced and trapped at the lower surface of the layer 11*c*. However, the negative charge predominates at the surface of the material 11 in the red image area. Thus, the surface potential on the material 11 is positive in the black image area, negative in the red image area and zero in the white image area.

Figure 2:
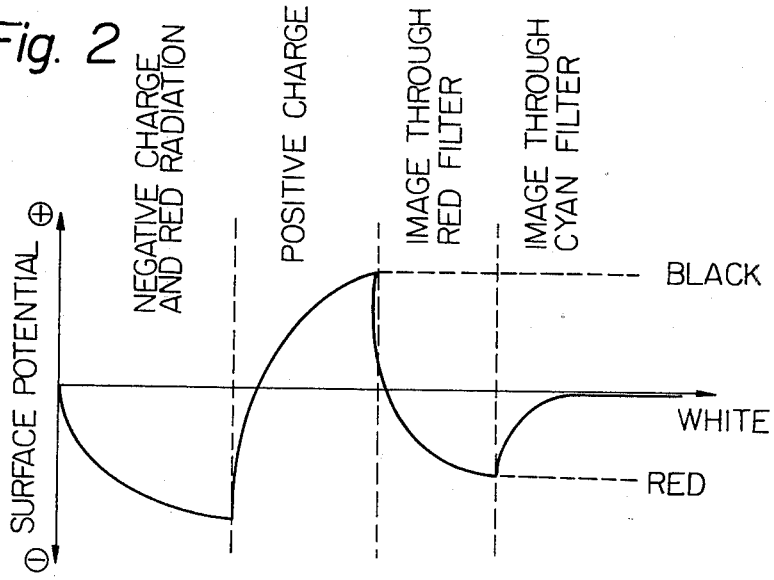
FIG. 2 is a graph illustrating the electrostatic potential on a photoconductive material during the various steps of the process.
Figure 3:
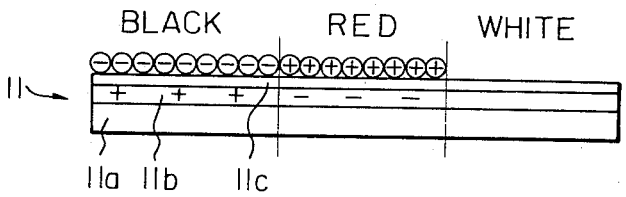
FIG. 3 is a schematic view illustrating a developing step of the present process.

FIG. 3 shows how the electrostatic image on the material 11 is developed to form a toner image which may be fixed to the material 11 or transferred and fixed to a copy sheet. A developing mixture comprising negative charged black toner particles and positive charged red toner particles is applied to the material 11. The negative black toner particles adhere to the positive black image area and the positive red toner particles adhere to the negative red image area of material 11. No toner particles adhere to the white image area since there is no electrostatic potential in this area. Thus, a two-color (black and red) copy is produced of the original document. FIG. 2 shows the surface potential of the material 11 during the various steps of the process.

In accordance with the present invention, it is possible to replace the steps of FIGS. 1*d* and 1*e* with a single step in which a light image of an original document is radiated onto the layer 11*c* without the use of any filter. Where the original document contains only red, black and white areas as with a commercial accounting document, a faithful copy will be produced. However, where the original document contains other colors such as green and blue, the resulting copy will lack contrast. Therefore, the use of the filters R and C is preferable in such cases.

In accordance with the present invention, other color combinations may be utilized other than red and black, for example red and another chromatic color. Charged toner particles of any colors may be used, as long as they are of the correct polarity, even if they do not correspond to the colors of the original document. The basic principle of the invention is to provide two photoconductive layers, one of which is sensitive to first and second colors and the other of which is sensitive to only the second color. In the present example, the first color is red and the second color is cyan (or the cyan component of white). It is further within the scope of the present invention, where two chromatic colors are to be reproduced, to have one layer sensitive to one of the colors and the other layer sensitive to the other color. An electrostatic image comprising positive and negative areas as well as zero potential areas may be produced utilizing many combinations of stratified charge patterns, colors and filters which are not specifically recited herein but which are within the scope of the present invention.

Figure 5:
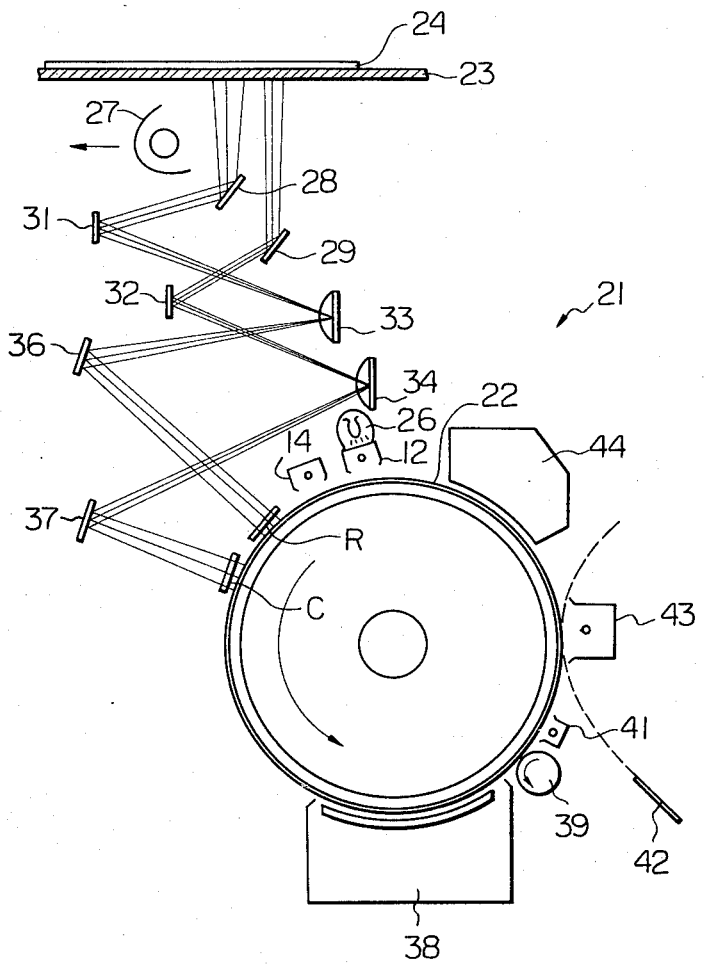
FIG. 5 is a schematic view of an apparatus for performing the process.

An electrostatic copying machine 21 for practicing the present method is illustrated in FIG. 5 and comprises a photoconductive drum 22 which is rotated counterclockwise at constant speed. Although not shown, the drum 22 is formed with a grounded, electrically conductive core and two photoconductive layers in the manner of the material 11.

A transparent platen 23 supports an original document 24 face down. A red lamp 26 is provided to the charger 12 to apply a negative charge to the drum 22 while illuminating the same with red light. The charger 14 is located downstream of the charger 12 and applies a positive charge thereto in the dark.

A white light source in the form of a lamp 27 is moved integrally with plane mirrors 28 and 29 from the right edge to the left edge of the document 24 for scanning the document 24 at the same surface speed as the drum 22. While the lamp 27 illuminates the document 24, the mirrors 28 and 29 reflect light images of linear portions of the document 24 thereabove to plane mirrors 31 and 32 respectively. It will be noted that the mirror 28 is upstream of the mirror 29 in the scanning direction (leftward).

The mirrors 31 and 32 are also moved leftwardly, but at one-half the surface speed of the drum 22. The mirrors 31 and 32 reflect the light images to converging lenses 33 and 34 which have rear reflecting surfaces. As a result, the light images are converged by the lenses 33 and 34 once, and then reflected back through the lenses 33 and 34 to be converged again. From the lenses 33 and 34 the light images are reflected to plane mirrors 36 and 37 which reflect the light images onto the drum 24 through the red and cyan filters R and C respectively. The filters R and C are spaced apart in the direction of movement of the drum 22 by the same distance the mirrors 28 and 29 are spaced apart in the direction of movement of the document 24. The light image passing through the red filter R reflected from the mirror 28 is upstream of the light image passing through the cyan filter C reflected from the mirror 29. In accordance with this arrangement, the light images passing through the filters R and C are superposed on the drum 22. The lamp 27 and mirrors 28 and 29 are returned to their original rightward positions after the scanning movement.

A dry or liquid developing mixture comprising negatively charged black toner particles and positively charged red toner particles is applied to the drum 22 by a developing unit 38 to form the two-color toner image. Where a liquid developing substance is used, a squeeze roller 39 removes excess liquid from the drum 22. A pre-charger 41 applies a large electrostatic charge to the toner image on the drum 22 to convert the charge of all of the toner particles to a single polarity. A copy sheet 42 is fed into contact with the drum 22 at the same surface speed thereas in register with the toner image. A transfer charger 43 applies an electrostatic charge of the opposite polarity to the charge of the toner image to attract and transfer the toner image from the drum 22 to the copy sheet 42. Although not shown, a fixing unit subsequently fixes the toner image to the copy sheet 42 using heat, pressure or a combination thereof. After transfer, a cleaning unit 44 discharges the drum 22 and removes any residual toner therefrom.

EXAMPLE 1

The drum 22 was manufactured by evaporating an inner layer of commercially available selenium having a purity of 0.9999 onto an aluminum cylinder. The thickness of the inner layer was 50 microns, the vacuum was $10^{-5}$ torr and the drum temperature was 75° C. The drum was left in the dark for 3 days to allow the inner layer to stabilize.

Then, an outer layer was formed by adding 0.1 mole of dinitrofluorenone to each mole of a resin prepared through condensation of 3-bromopyrine and formaldehyde to a thickness of 10 microns on the inner layer to form an organic photosemiconductor. The outer layer had a spectral sensitivity as shown in FIG. 4 and transmitted 80% of all light having a wavelength longer then 600 millimicrons.

The drum 22 was charged by the charger 12 to a potential of −900 V while being rotated at a surface speed of 20 mm/sec. The diameter of the electrode in the charger 12 was 0.08 mm, the gap between the electrode and the drum surface was 10 mm and the applied voltage was −7.0 KV.

The drum 22 was then charged by the charger 14 to which was applied a voltage of +5.6 KV. The surface potential after the second charging was +1080 V.

After imaging of the drum 22 through the red filter R, the surface potential was reduced to −800 V in the white areas and to −550 V in the red areas. After imaging through the cyan filter C, the potential in the black areas was +980 V, in the red areas −480 V and in the white areas −70 V. Development with oppositely charged red and black toner particles produced an excellent two-color copy.

EXAMPLE 2

Similarly excellent results were obtained using an inner layer 30 microns thick comprising CdS resin doped with $10^{-5}$ moles of Cu and an outer layer 5 microns thick produced by sensitizing 1:1 zinc oxide silicone resin with Rose bengale and reversing the polarities of the chargers 12 and 14.

FIGS. 6*a* to 6*d* illustrate a second version of the present process. A material 11' is essentially similar to the material 11 except for the composition of an outer layer 11*c'*, which has a spectral sensitivity as illustrated in FIG. 8. It will be noted that the outer layer 11*c'* is insensitive to red light as is the outer layer 11*c*. An inner layer 11*b'* is sensitive to visible light.

Figure 6A:
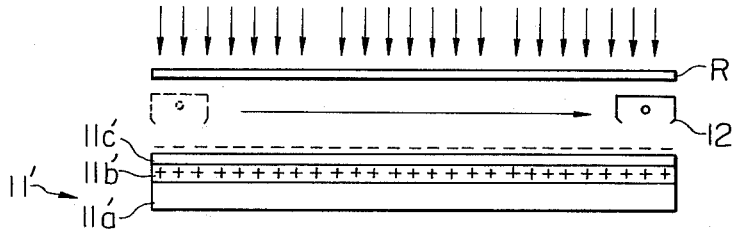
FIGS. 6*a* to 6*d* are schematic views illustrating a second version of the present process.
Figure 6B:
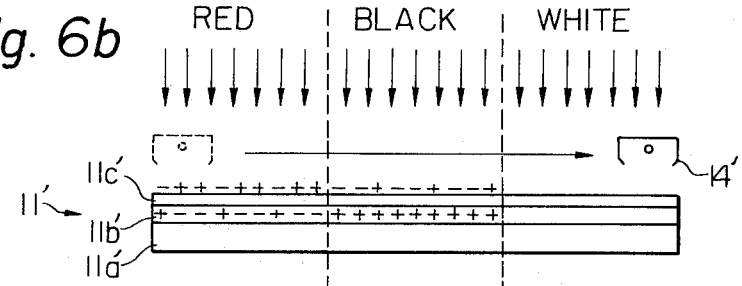

The first step of the process, as shown in FIG. 6*a*, is identical to the step shown in FIG. 1*b*. Namely, the outer layer 11*c'* is radiated with red light by the lamp 26 while being negatively charged by the charging unit 12. In the next step, illustrated in FIG. 6*b*, the outer layer 11*c'* is positively charged by a charging unit 14' while a light image of an original document is radiated thereon without filtration.

In the black image areas, there is no photoconduction of either of the layers 11*b'* and 11*c'*. Although the charge on the upper surface of the outer layer 11*c'* remains negative, the net potential at the surface of the material 11 in the black image areas becomes positive.

In the white image areas, both layers 11*b'* and 11*c'* are rendered photoconductive and all electrostatic charge is dissipated. In the red image areas, the layer 11*b'* is rendered conductive and the surface potential of the material 11 becomes positive.

Figure 6C:
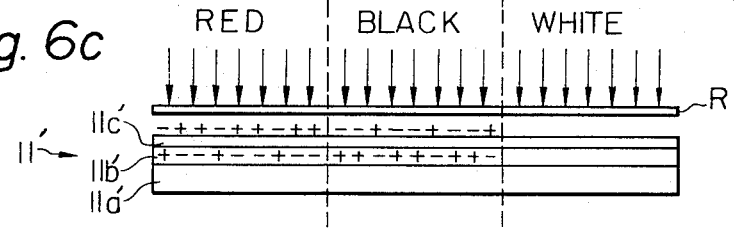

The next step of the process is illustrated in FIG. 6*c*, in which the layer 11*c'* is radiated with red light (or white light through the red filter R). This causes the layer 11*b'* to conduct. Although there is no substantial effect in the red and white image areas, the trapped positive charge at the interface of the layers 11*b'* and 11*c'* is dissipated in the black image areas. The positive charge at the lower surface of the outer layer 11*c'* becomes equal to the negative charge at the upper surface thereof. As the result of this action, the surface potential of the material in the black image areas becomes negative.

Figure 6D:
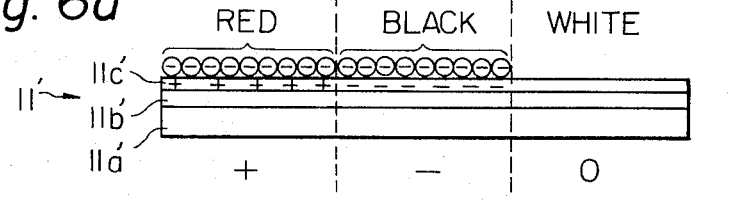

In summary, the potential in the white, red and black image areas becomes zero; non-zero and positive; and non-zero and negative respectively. The resulting electrostatic image is developed by means of negatively charged red toner particles and positively charged black toner particles respectively, as shown in FIG. 6*d*. FIG. 7 illustrates the surface potential of the material 11' during the various steps of the process.

It will be understood that the red filter R illustrated in FIG. 6*c* may be omitted if a red light source is provided. Alternatively, a red filter layer may be formed between the layers 11*b'* and 11*c'*, although not illustrated. Such a filter layer preferably is 1 to 3 microns thick and has a volume resistivity on the order of $10^{10}$ to $10^{13}$ ohm-cm.

Figure 9:
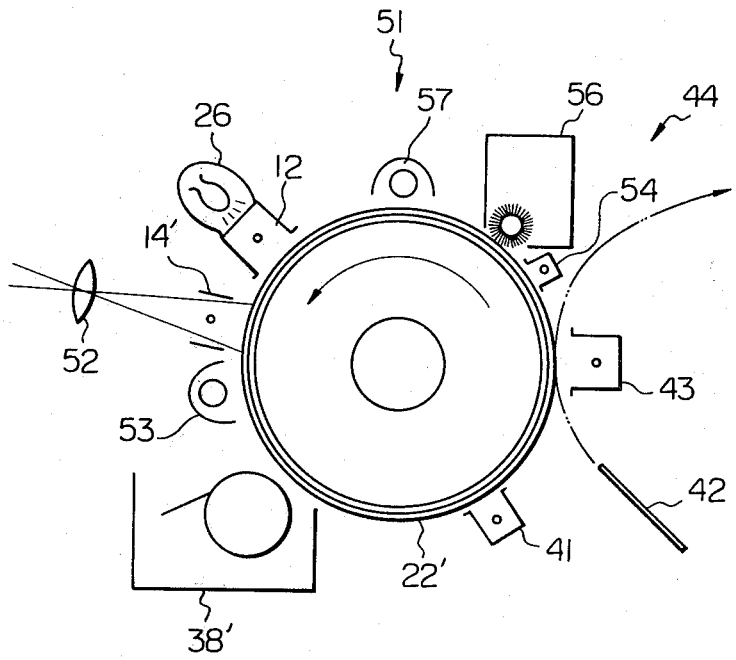
FIG. 9 is a schematic view of an apparatus for practicing the second version of the process.

An apparatus 51 for performing the process of FIGS. 6*a* to 6*d* is shown in FIG. 9. Like or corresponding elements are designated by the same reference numerals used in FIG. 5 and modified but analogous elements are designated by the same reference numerals primed.

In the apparatus 51 a single light image of an original document is focussed onto a drum 22' by a converging lens 52. The mechanism for scanning the document is not shown. The charging unit 14 is replaced by the charging unit 14' through which the light image passes. A red lamp 53 illuminates the drum 22' with red light after the imaging exposure. The cleaning unit 44 is shown in more detail as comprising a discharging unit 54 for discharging the drum 22', a magnetic brush unit 56 for removing residual toner particles from the drum 22' and a lamp 57 for illuminating the drum 22' to render the same photoconductive and ensure complete discharge thereof. The other units of the apparatus 51 function in the same manner as those of the apparatus 21.

EXAMPLE 3

The core and inner layer of the drum 22' were formed in the same manner as in EXAMPLE 1. The outer layer was formed by adding 0.1 mole of mononitrofluorenone sensitizer to each mole of bromopyrine resin, and forming the outer layer on the inner layer to a thickness of 10 microns. The spectral sensitivity of the outer layer is shown in FIG. 8. The voltage applied to the charging unit 12 was −6.2 KV. The voltage applied to the charging unit 14' was +4.9 KV. An original document was illuminated with white light, and a light image thereof focussed onto the drum 22' during the second charging. The document was a sheet of white paper on which were markings made by a red fountain pen, red ball point pen and red pencil. Additional markings were made on the sheet with a black fountain pen, black ball point pen and black pencil.

After the imaging operation the surface potential of the drum 22' was approximately +200 V in the red and black areas and zero in the white areas.

Then, the drum 22' was illuminated by a red 10 watt fluorescent lamp. The surface potential of the drum 22' remained +200 V in the red image areas, zero in the white image areas but changed to −550 V in the black image areas. After development with positive black toner particles and negative red toner particles, the resulting copy produced by transferring the toner image to a copy sheet was bright and clear without blending of colors.

EXAMPLE 4

This example is essentially similar to EXAMPLE 3 except that the outer layer was replaced with one formed by dispersing CdS resin doped with Cu (manufactured by the Nikosha Co., Ltd. of Japan) in silicone resin KR 251 (manufactured by the Shinetsu Kagaku Co., Ltd. of Japan), and the polarities of the charging units 12 and 14' were reversed. Similarly excellent results were obtained.

Figure 10:
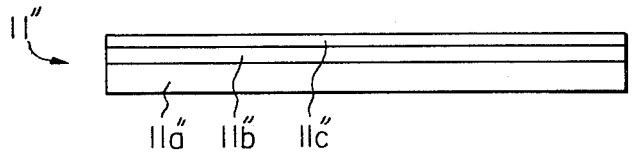
FIG. 10 is a schematic view of a photoconductive material for practicing a third version of the process.

FIG. 10 illustrates a photoconductive material 11'' adapted to produce two-color copies in accordance with a third version of the present process illustrated in FIGS. 13*a* to 13*d*. In this example, it will be assumed that it is desired to produce copies in red and blue on a white background.

Figure 11:
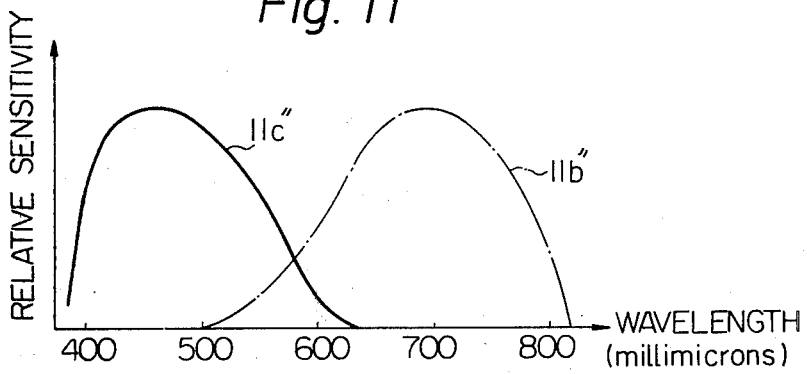
FIGS. 11 and 12 are graphs illustrating the spectral sensitivity of the photoconductive material of FIG. 10.

The spectral sensitivities of inner and outer layers 11b'' and 11c'' of the material 11'' which are formed on a conductive substrate 11a'' are shown in FIG. 11. The inner layer 11b'' is most sensitive to red light and is insensitive to all wavelengths below about 500 millimicrons. The outer layer 11c'' is most sensitive to blue light and is insensitive to all wavelengths above about 630 millimicrons.

Figure 13A:
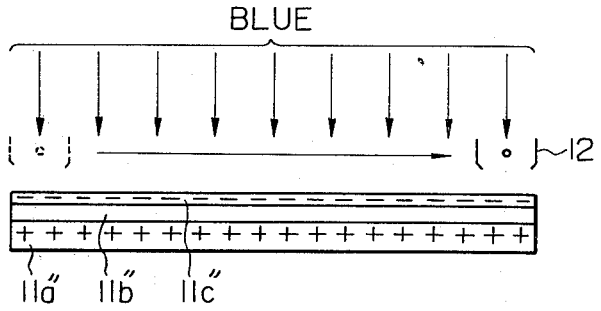
FIGS. 13*a* to 13*d* are schematic views illustrating the third version of the process.

In the first step of the process, as illustrated in FIG. 13a, the outer layer 11c'' is negatively charged by the charger 12 while being radiated with blue light. In all versions of the process, the charge applied by the charger 12 is comparable to that used in the standard Carlson process.

The blue light causes the outer layer 11c'' to conduct, so that a negative charge is applied to the upper surface of the lower layer 11b''. A positive charge is induced on the lower surface of the lower layer 11b''. The negative charge at the interface of the layers 11b'' and 11c'' is trapped when radiation of the blue light is terminated.

Figure 13B:
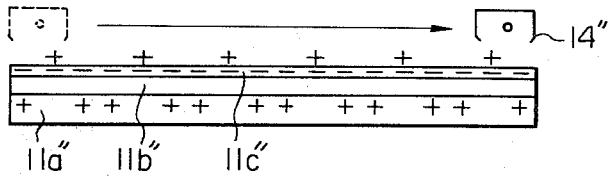
Figure 14:
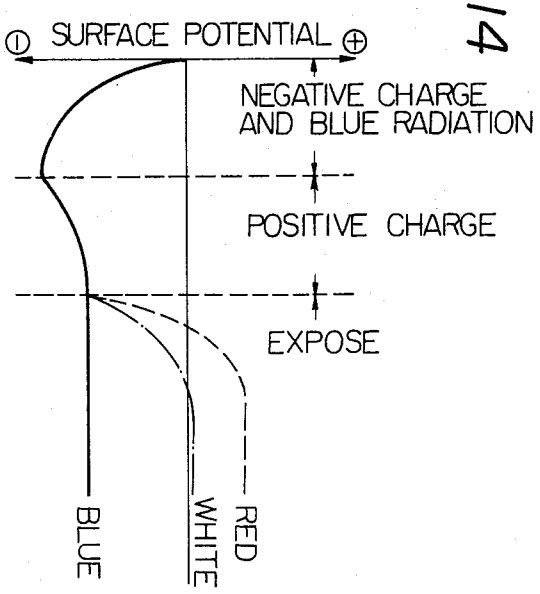
FIG. 14 is similar to FIG. 2 but illustrates the third version of the process.

Next, as shown in FIG. 13b, a charging unit 14'' applies a positive charge to the upper surface of the upper layer 11c'' in the dark. In accordance with the third version of the present process, the second charging is insufficient to reverse the polarity of the surface potential of the material 11'', as shown in FIG. 14. However, the charge on the upper surface of the upper layer 11c'' is positive.

Then, a light image of an original document is radiated onto the outer layer 11c'' through the yellow filter R or a filter adapted to block only blue light. In white areas of the image, which contain both red and green components, both the layers 11b'' and 11c'' conduct, reducing the surface potential to zero. In the blue areas, there is no change since blue light is blocked, and the surface potential remains negative. In the red areas, however, the inner layer 11b'' conducts, thereby dissipating the negative charge at the upper surface thereof. Since the outer layer 11c'' does not conduct, the positive charge at the upper surface thereof remains. The negative charge at the lower surface of the outer layer 11c'' is reduced until it is equal to the positive charge at the upper surface of the outer layer 11c''. In the red image areas, the positive charge at the upper surface of the outer layer 11c'' predominates, and the surface potential of the material 11'' becomes positive. In summary, the surface potential in the blue, red and white image areas is non-zero and negative; non-zero and positive; and zero respectively. A two-color toner image is produced as shown in FIG. 13d by applying positively charged blue toner particles and negatively charged red toner particles to the material 11.

Figure 15:
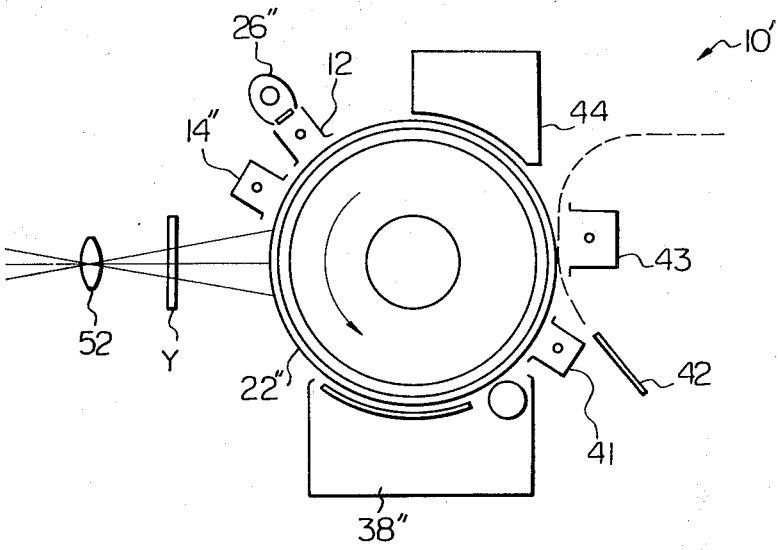
FIG. 15 is a schematic view of an apparatus for practicing the third version of the process.

An apparatus 10' for performing the third version of the process is shown in FIG. 15 in which like elements are designated by the same reference numerals used previously. A blue lamp 26'' radiates a drum 22'' while the charging unit 12 applies the negative charge. The charging unit 14'' then applies the positive charge, after which time the drum 22'' is imaged through the filter Y. A developing unit 38'' applies red and blue toner particles to the drum 22''.

Figure 13C:
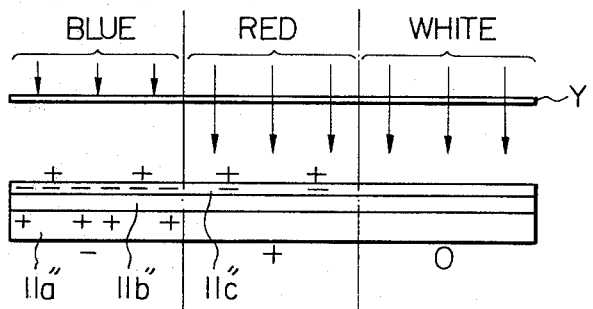
Figure 13D:
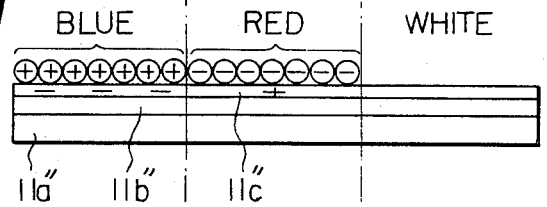

It will be noted that the filter Y may be replaced by a dichroic filter or the like designed to absorb or reflect only blue light but pass all other colors in the step of FIG. 13c.

Regarding the magnitudes of charges applied by the charging units 12 and 14'', where the unit 12 applies a charge having a density of $|\sigma 1|$ and the unit 14'' applies a charge having a density $|\sigma 2|$, the relation $|\sigma 1| > |\sigma 2|$ holds in the third version of the process. The second charge must have sufficient density to attract negatively charged toner particles to the red image areas after exposure to the light image. The developing unit 38'' may apply the red and toner particles to the drum 22'' either as a mixture or separately in a sequential manner.

EXAMPLE 5

A drum was prepared by forming an inner layer 50 microns thick on an aluminum cylinder. The inner layer was formed through vacuum deposition of selenium. An outer layer 12 microns thick was formed on the inner layer and comprised bromopyrine sensitized with dinitrofluorenone.

Figure 12:
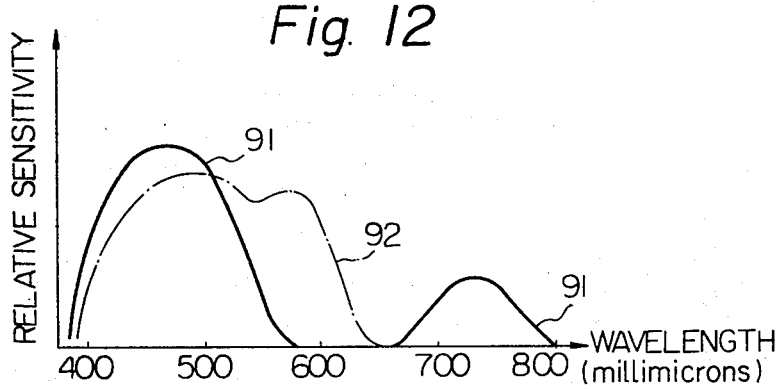

The spectral sensitivities of the inner and outer layers are illustrated in FIG. 12 as curves 91 and 92 respectively. It will be noted that both layers are sensitive to light up to about 550 millimicrons, but that the outer layer is also sensitive to wavelengths up to about 650 millimicrons. The inner layer is further sensitive to wavelengths between about 650 to 800 millimicrons.

A positive charge was applied to the drum with an applied voltage of 5.5 KV. Simultaneously, the drum was illuminated with light of wavelengths between 550 and 650 millimicrons to render the outer layer conductive. The lamp may be adapted to emit light of such wavelengths or be provided with a suitable filter. The surface potential of the drum after this step was about +950 V. It will be noted that the primary charge polarity is opposite to that illustrated in FIGS. 13a to 13d, as is the subsequent second charging.

The second charging was performed at an applied voltage of −4.7 KV, reducing the surface potential to +580 V. After exposure to the light image of the document through a yellow filter, the potential in the red areas was −90 V, the potential in the blue areas was +550 V and the potential in the white areas was +30 V. Development was performed using positive charged red toner particles and negative charged blue toner particles. This process was repeatedly performed and produced over 50,000 blue and red copies of excellent quality.

It is also possible to provide a thin layer of an electrically rectifying material between the substrate and inner layer of the present photoconductive material to reduce dark decay and improve contrast. Such a layer may be formed of $Al_2O_3$ or the like.

In summary, it will be seen that the present invention provides an improved process and material for producing excellent copies in any two colors at high speed and low cost using a simple and inexpensive apparatus. Various modifications will become possible for those skilled in the art after receiving the teachings of the present disclosure without departing from the scope thereof.

What is claimed is:

1. A two-color electrostatographic process utilizing a photoconductive material having a conductive substrate, a first photoconductive layer formed on the substrate and a second photoconductive layer formed on the first layer, said first and second layers having different spectral sensitivity, the process comprising the steps of:

(a) applying a first electrostatic charge of a polarity to the second layer, step (a) being performed while radiating the second layer with light to render only one of the first layer and the second layer photoconductive;

(b) applying a second electrostatic charge to the second layer in the absence of light to neutralize a portion of the first electrostatic charge on the second layer; and (c) radiating a light image onto the second layer, magnitude of the first and second electrostatic charges being selected in such a manner as to form a substantially zero surface potential area, a first electrostatic iamge area of a first polarity and a second electrostatic iamge area of a second polarity opposite to the first polarity of the first electrostatic image area on the photoconductive material.

2. A process as in claim 1, in which the first photoconductive layer comprises an electrically rectifying material.

3. A process as in claim 3, in which step (a) is performed in the dark.

4. A process as in claim 1, in which steps (b) and (c) are performed simultaneously.

5. A process as in claim 1, in which an electrically rectifying layer is formed between the substrate and the first layer.

6. A process as in claim 1, in which the first layer is sensitive to visible light of all colors.

7. A process as in claim 6, in which the second layer is sensitive to cyan.

8. A process as in claim 1, in which the spectral sensitivity of the second layer is partially common to that of the first layer.

9. A two-color electrostatographic process utilizing a photoconductive material having a conductive substrate, a photoconductive inner layer formed on the substrate and a photoconductive outer layer formed on the inner layer, one of the inner and outer layers being rendered photoconductive by light of a first color and a second color, the other of the inner and outer layers being rendered photoconductive by light of the second color and insensitive to light of the first color, the outer layer being at least partially transparent to light of the first and second colors, the process comprising the steps of:

(a) applying a first electrostatic charge to the outer layer;

(b) radiating the outer layer with light of a color selected to render only one of the inner and outer layers photoconductive;

(c) applying a second electrostatic charge of a polarity opposite to a polarity of the first electrostatic charge to the outer layer in the absence of light; and (d) radiating a light image onto the outer layer, magnitudes of the first and second electrostatic charges being selected in such a manner that, subsequent to step (d), an electrostatic surface potential of the photoconductive material is substantially zero; non-zero and of a first polarity; and non-zero and of a second polarity in areas of the light image of the second color; the first color; and void of color respectively.

10. A process as in claim 9, in which the first color is red.

11. A process as in claim 9, in which the second color is white.

12. A process as in claim 10, in which the second color is cyan.

13. A process as in claim 9, in which the light image is radiated onto the outer layer through a filter of the first color in step (d), the process further comprising the step of:

(e) radiating the light image onto the layer through a filter of the second color.

14. A process as in claim 9, in which light of the first color is radiated onto the outer layer in step (b) to render only the inner layer photoconductive.

15. A process as in claim 9, in which steps (a) and (b) are performed simultaneously.

16. A process as in claim 9, in which steps (c) and (d) are performed simultaneously.

17. A process as in claim 9, further comprising the step of:

(f) radiating the outer layer with light of the first color.

18. A process as in claim 9, in which the magnitude of the second electrostatic charge applied in step (c) is sufficient to reverse the polarity of the surface potential of the photoconductive material.

19. A process as in claim 9, in which the magnitude of the second electrostatic charge applied in step (c) is insufficient to reverse the surface potential of the photoconductive material.

* * * * *